United States Patent [19]

Comtois et al.

[11] Patent Number: 4,727,226

[45] Date of Patent: Feb. 23, 1988

[54] PROTECTIVE SWITCH WITH COUPLABLE POLES

[75] Inventors: Patrick Comtois, Chevigny Saint Sauveur; Luc Moreau, Dijon; Serge Paggi, Ruffey les Echirey, all of France

[73] Assignee: La Telemecanique Electrique, France

[21] Appl. No.: 75,253

[22] Filed: Jul. 17, 1987

Related U.S. Application Data

[63] Continuation of Ser. No. 882,000, Jul. 3, 1986, abandoned.

[30] Foreign Application Priority Data

Jul. 5, 1985 [FR] France ..... 85 10298

[51] Int. Cl.[4] ..... H01H 9/20

[52] U.S. Cl. ..... 200/50 C; 200/307

[58] Field of Search ..... 200/18, 50 C, 307; 335/8, 9, 10; 337/50

[56] References Cited

U.S. PATENT DOCUMENTS

| | | | |
|---|---|---|---|
| 2,824,191 | 2/1958 | Christensen | 337/50 |
| 2,967,917 | 1/1961 | Cole | 200/50 C |
| 3,069,517 | 12/1962 | Cole | 335/9 |
| 4,112,270 | 9/1978 | Rys | 200/307 X |

*Primary Examiner*—J. R. Scott

*Attorney, Agent, or Firm*—William A. Drucker

[57] ABSTRACT

The switch of the invention includes, for each pole, an insulating case having two lateral dividing walls one of which forms part of an open pole housing and the other belongs to a closure element of the case. Each pole includes a contact opening mechanism with which is associated a common transmission piece for coupling said pole with an adjacent pole. This piece is mounted for rotation in a bearing formed in the lateral dividing wall of the case. It has at one end a male coupling element and at a second end a female coupling element, these elements being of complementary shapes for allowing engagement of adjacent and coaxial coupling pieces by fitting together.

2 Claims, 3 Drawing Figures

PROTECTIVE SWITCH WITH COUPLABLE POLES

This application is a continuation of application Ser. No. 882,000 now abandoned, filed July 3, 1986.

BACKGROUND OF THE INVENTION

1. Field of the Invention

The present invention relates to an electric single or multipole protective switch having for each pole a case with a piece for coupling to a neighboring pole or to a juxtaposable supplementary apparatus. Such a coupling serves for transmitting from one pole to the other or from one pole to an adjacent apparatus, a mechanical signal for tripping and/or signalling should there be a defect or following a voluntary control action.

Such known multipole apparatus generally require, for providing coupling between the poles, one or more coupling pieces which must be fixed by engagement or insertion on or in transmission pieces belonging to the tripping mechanisms of the different poles.

2. Description of the Prior Art

Thus, in the patent FR No. 1 596 145, a single pole or mutipole switch is proposed having in its single pole version a case and a lid and in its mutipole version a case, intermediate pieces disposed in number equal to the desired number of poles and a lid; each pole includes a lever which contributes to the coupling by means of a common through mounting pin, this pin coupling the different levers together, it is then necessary to provide pins of different lengths for coupling the levers during manufacture of switches having different numbers of poles.

There exist other couplable single pole or multipole protective switches, but these switches have the disadvantage of requiring either a high number of pieces for building up the boxes and the couplings of the single pole version and of the different multipole versions, or they occupy too great width in the case because of the projections of the coupling pieces.

The invention has more especially as object to simplify the design and mounting of a protective switching apparatus with couplable poles by using a minimum number of constituent parts adapted not only to a single pole version but to the different multipole versions.

Its aim is, while simplifying the construction of such a protective switching apparatus, to confer thereon a minimum thickness resulting in low space occupancy in width and allowing if required the construction of modular versions.

SUMMARY OF THE INVENTION

It relates to a single pole or multipole protective electric switch having for each pole a prismatic insulating case with two lateral dividing walls, the first lateral dividing wall forming part of an open housing, the second dividing wall belonging to a closure element fixed to the housing for closing the case, each plane of symmetry of a pole being separated from that of an adjacent pole by a so called pole pitch distance, each pole including a tripping mechanism with which is associated a transmission piece movable in response to an actuation, the transmission piece cooperating with a piece for coupling the pole to an adjacent pole.

According to the invention the transmission piece and the coupling piece form a single part disposed for rotation in a bearing formed in the lateral wall of the housing and with axis perpendicular to the dividing wall, the coupling piece having at a first end a male coupling element and at a second end a female coupling element, these coupling elements being of complementary shapes for allowing engagement by direct fitting together of adjacent and coaxial coupling pieces; in addition, the pole housing is in the form of a cup housing the tripping mechanism and the coupling piece.

The protective switch may thus be formed with a small number of constituent parts, namely a pole housing forming a cup which contains the tripping mechanism and its combined transmission and coupling piece, intermediate pole housings of a single type forming as many cups which contain the tripping mechanisms of the successive poles and a lid for closing the cup of the last pole. The assembly of the protective switch is facilitated by stacking the pole cups of low height and substantially identical, which are easy to store and to handle manually or automatically. In particular, each pole housing is equipped with its coupling piece before stacking of the next pole housing, because its coupling piece forms part of its own contact tripping or opening mechanism.

It is advantageous for the coupling piece or pieces not to project outside the lateral dividing walls of the single pole or respectively multipole case, and for the male coupling element of a first coupling piece to be housed in a recess of a lateral dividing wall of the case, the dimensions of the recess allowing the female coupling element of a second coupling piece, coaxial with and adjacent to the first one, to be housed therein. The recess is preferably edged by at least one bearing surface perpendicular to the axis of the coupling pieces for receiving a corresponding bearing collar provided on one at least of the coupling pieces. Preferably, in combination with the fact that the stack of coupling pieces does not project from the housing of the switch, the total width of the housing of the switch is provided slightly greater than a multiple of the pole pitch and the length of each coupling piece is slightly greater than the pole pitch.

BRIEF DESCRIPTION OF THE DRAWINGS

The following description of one non limitative embodiment with reference to the accompanying drawings will explain other features and advantages of the invention.

DESCRIPTION OF THE PREFERRED EMBODIMENTS

Figure 1:
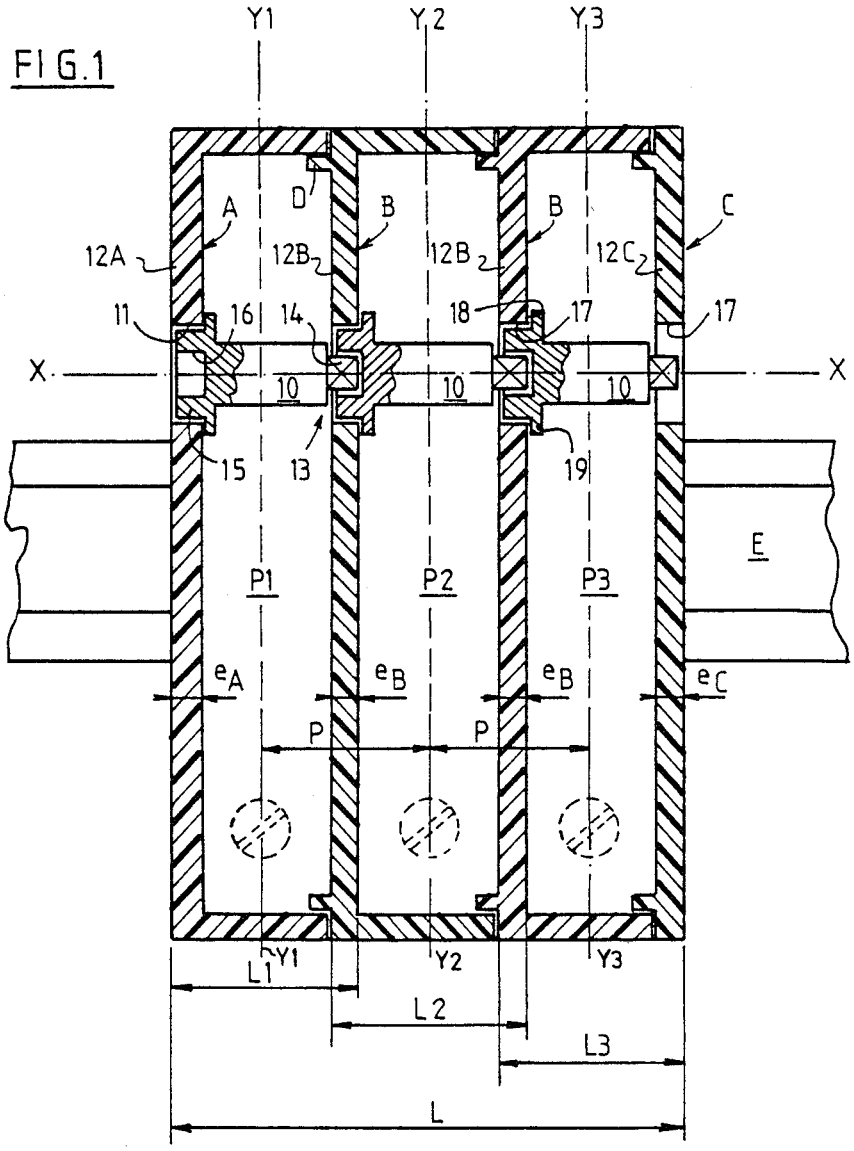
FIG. 1 shows schematically in section a three pole protective switch in accordance with the invention.
Figure 2:
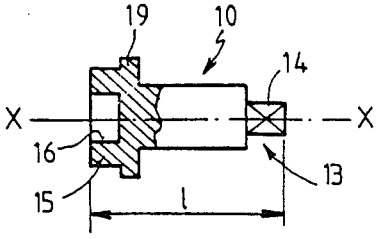
FIG. 2 shows an axial section of a coupling piece of the switch.

The switch illustrated in FIG. 1 is a three pole switch; each of the poles P1, P2, P3 has contacts which are separable should an electric fault be detected or following a voluntary manoeuver. The tripping and manoeuvering mechanisms have not been shown for the sake of clearness.

The case of the switch includes for pole P1 an insulating pole housing in the form of a cup A and for poles P2 and P3 insulating pole housings also in the form of a cup B, the housing for pole P3 being closed by an insulating lid C; it will be readily understood that thus there is associated with each pole a closed prismatic case formed, on the one hand, by a cup A or B and, on the other, depending on the case, by the bottom of an adjacent cup or by the cover C. The dividing walls of the bottoms of cups A, B and the dividing wall of lid C have respectively thicknesses referenced $e_A$, $e_B$ $e_C$. The pole housing B differs slightly from pole housing A because it has engagement projections D, whereas the external wall of housing A is smooth. The case of the switch has elements not shown for fixing to a support such as a rail E or a perforated plate. The mutual fixing of the elements A, B, C is provided for example by riveting.

In interdependence with the pole pitch P and the thicknesses $e_A$, $e_B$, $e_C$ of the external and internal walls of the switch, the toal width L of the case of the switch is provided slightly greater than a multiple of the pole pitch; for example with n poles, $L=nP+x$, with $x=e_A+e_{C-}e_B$.

In FIG. 1 have been shown the planes of symmetry Y1—Y1, Y2—Y2, Y3—Y3 for the terminals and the separable contacts of poles P1-P3, these planes being spaced apart by the pole pitch P.

In each pole case is housed a combined transmission and coupling piece 10. Pieces 10 are identical and are disposed coaxially along an axis X—X perpendicular to the planes $Y_1$—$Y_1$, $Y_2$—$Y_2$, $Y_3$—$Y_3$. Each piece 10 forms part of the tripping mechanism of the respective pole ; it is mounted for rotation in a bearing 11 formed in a wall or lateral dividing wall 12A, 12B, 12C and it has at its first end 13 a male coupling element 14 and at its second end 15 a female coupling element 61 in which the male element 14 of the adjacent coupling piece fits.

Each coupling end 10 is engaged in a recess 17 formed in the wall 12A, 12B, 12C. Recess 17 is edged by at least one bearing surface 18 perpendicular to the axis X—X for receiving a corresponding bearing collar 19 of piece 10. Such bearing surfaces and collars may be provided at both ends of piece 10.

The coupling piece 10 has a length 1 which is less than the width L1 (or L2 or L3) of the corresponding pole housing, but which is greater than the pole pitch P by a value at most equal to x, for example slightly less than x by a difference j. Thus, the coupling pole pieces 10 of adjacent poles fit into each other over a depth (x−j) without requiring additional parts and without projecting from the external walls 12A and 12C at the left and at the right of the switch.

Figure 3:
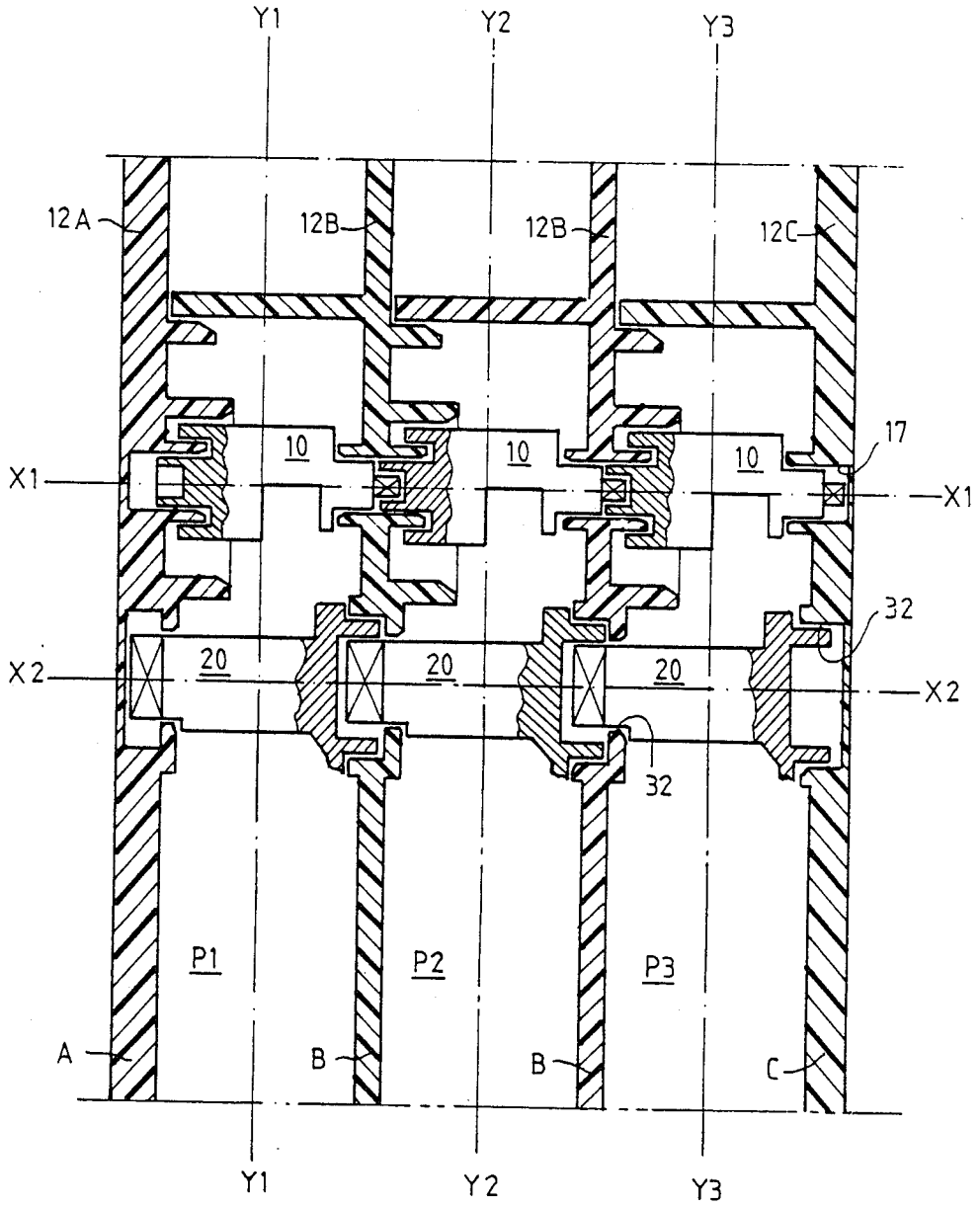
FIG. 3 shows with slightly more detail a variant of the switch of FIG. 1.

FIG. 3 shows a three pole protective switch which includes a first column of pivoting coupling pieces 10 coaxial with axis X1—X1 and a second column of pivoting coupling pieces 20 coaxial with axis X2—X2 parallel to X1—X1. Each piece 10 is urged by a means tripping on a fault, magnetic and/or thermal for acting on a contact holder, not shown. Thus, piece 10 forms part of the mechanism for actuating the pole considered.

One of pieces 20 can be urged by a means for voluntary opening of the contacts and for resetting them for acting on the contact holder of the pole concerned. The rotary movement of piece 20 is transmitted to an adjacent piece 20. If the master piece 20 belongs to the central pole P2, it controls the slave pieces 20 of the lateral poles P1, P3. The pieces 20 are identical to each other and they offer in particular the same characteristics of conformation and length.

The recesses 17 associated with pieces 10 and the corresponding recesses 32 associated with pieces 20 are through-recesses when they are formed in the internal walls 12B of the switch. They may be either through-recesses (FIG. 1), or blind recesses defined by breakable sections (FIG. 3) for coupling to an additional apparatus juxtaposable with the switch when they are formed in the external walls 12A, 12C of the switch.

It should be noted that the arrangement adopted for the switch with couplable poles requires a minimum number of pieces suitable not only for the single pole version but also for the different multipole versions: cup A, cup B, lid C, coupling piece 10 for automatic tripping and coupling piece 20 for voluntary control and resetting, without additional connection pieces.

In the case where each pole housing has a front open face, it is advantageous to add to the single pole or multipole housing of the switch a cover whose width is substantially that of the stack. This cover may then cover the whole of the front open and projecting part of the poles; in addition, it supports the voluntary opening and resetting means, for example the control button of the switch.

Thus, the control member may be preassembled on the cover for fixing the whole by snap fitting on the front of the case.

The pole pitch is preferably a fraction of a standardized width, this fraction being equal to the ration of two whole numbers chosen so that, whatever the number of poles, a composition of modular apparatus may be obtained whose width may be equal to a multipole of the standardized width, or, in the less favorable cases, will exceed said multiple by an amount equal to half the standardized width.

EXAMPLE 1

With a standardized width W=9 mm, the pole pitch P is chosen preferably equal to 3/2 W, that is to say to 13.5 mm and $x=L-nP$ is equal to 4.5 mm. Thus the following range of apparatus is obtained:

| Number of Poles | Pole pitch (mm) | x (mm) | Width L of the apparatus (mm) | Ratio L/W |
|---|---|---|---|---|
| 1 | 13.5 | 4.5 | P + x = 18 | 2 |
| 2 | 13.5 | 4.5 | 2P + x = 31.5 | 3.5 |
| 3 | 13.5 | 4.5 | 3P + x = 45 | 5 |
| 4 | 13.5 | 4.5 | 4P + x = 58.5 | 6.5 |
| 5 | 13.5 | 4.5 | 5M + x = 72 | 8 |

EXAMPLE 2

With the same standardized width W=9 mm, the pole pitch is preferably chosen equal to 5/2 W, that is to say to 22.5 mm, and $x=L-nP$ is equal to 4.5 mm. Thus the following range of apparatus is obtained:

| Number of Poles | Pole Pitch (mm) | x (mm) | Width L of the apparatus (mm) | Ratio L/W |
|---|---|---|---|---|
| 1 | 22.5 | 4.5 | P + x = 27 | 3 |
| 2 | 22.5 | 4.5 | 2P + x = 49.5 | 5.5 |
| 3 | 22.5 | 4.5 | 3P + x = 72 | 8 |
| 4 | 22.5 | 4.5 | 4P + x = 94.5 | 10.5 |
| 5 | 22.5 | 4.5 | 5P + x = 117 | 13 |

It should be observed that, in each case, the total width of the case of the switch is greater by a standardized half width W/2 than an appropriate multiple of the pole pitch. The total width of a case with n poles may as a variant be greater by a standardized width W than n times the pole pitch.

What is claimed is:

1. In a multipole circuit breaker having at each pole thereof a movable contact member and at least one operating mechanism cooperating with said movable contact member to open and close the circuit and a housing for said movable contact member and said operating mechanism, the housings of the respective poles are formed of a stack of cup-like prismatic boxes each having a plane bottom wall and four side walls, the side walls of each of the respective boxes of the stack, excepting the last one, being in fitting engagement with the plane bottom wall of an adjacent box, and a plane cover being in fitting engagement with the side walls of the last box to close the housing of the corresponding pole, each of said boxes defining an inner volume having a predetermined width from one internal wall face thereof to the opposite internal face thereof; a plurality of bearings formed in the respective bottom walls and arranged for defining at least one axis of rotation at right angles to said bottom walls, the respective operating mechanisms comprising respective elongate members mounted in the respective bearings for rotation about said axis and each having at a first end thereof a male coupling portion and, at a second end thereof, a female coupling portion, openings being respectively provided onto the respective bottom walls for allowing engagement of each male coupling portion into the female coupling portion of an adjacent elongate member to couple the respective operating mechanisms together.

2. The multiple circuit breaker as claimed in claim 1, wherein said plurality of bearings defines first and second parallel axes of rotation and first and second lines of elongate members are respectively mounted for rotation about said first and second axes.

* * * * *